United States Patent [19]

Brandell

[11] 4,249,739

[45] Feb. 10, 1981

[54] GOLF PUTTING PRACTICE DEVICE

[76] Inventor: John R. Brandell, 427 Shore Line Rd./LBS, Barrington, Ill. 60010

[21] Appl. No.: 101,868

[22] Filed: Dec. 10, 1979

[51] Int. Cl.[3] ..... A63B 69/36; A63B 57/00

[52] U.S. Cl. ..... 273/179 A; 273/122 A

[58] Field of Search ..... 273/179 A, 179 R, 127 C, 273/185 R, 122 A

[56] References Cited

U.S. PATENT DOCUMENTS

| | | | |
|---|---|---|---|
| 2,908,503 | 10/1959 | Austin et al. | 273/179 A |
| 3,697,079 | 10/1972 | Brandell | 273/179 A |
| 3,854,728 | 12/1974 | Brandell | 273/179 A |

*Primary Examiner*—George J. Marlo

*Attorney, Agent, or Firm*—Emrich, Root, Lee, Brown & Hill

[57] ABSTRACT

A golf putting practice device having a ramp with a ball receiving pocket therein, a kicker being disposed in position to return putted balls falling into the pocket, and a rib disposed in upright position in the front portion of the pocket to engage and stop balls rolling laterally across the pocket, the rib having an upwardly and forwardly sloping upper surface for deflecting balls upwardly and forwardly out of the pocket.

10 Claims, 5 Drawing Figures

36'
6
30
31
4
5
1
2
35'
32
20
21
22
14
12
37
16
15
3
4
5
18
19
17
5
35
4
13
44
8
7
41
42
45
43
3
2
1
2
3
46
47
48
49
9
10
11

3
6
5
1
2
7
23
32
8
9
14
37
12
10
3
41
47
45
44
2
42
1
43
2
3
42
13
11
48
49
3

1
7
2
B'
B'
12
17
14
29
23
4
24
3
32
34
35
36
13
37
15
18
38
25
26
27
28
33

15
7
14
13
12
35
36

7
14
14
15
12

GOLF PUTTING PRACTICE DEVICE

BACKGROUND OF THE INVENTION

This invention relates to golf putting practice devices, and, more particularly, to golf putting practice devices of the type adapted to return a ball to a person making a putt.

It is a primary object of the present invention to afford a novel golf putting practice device.

Another object is to afford a novel golf putting practice device which, after receiving the ball, will return the same substantially to the place or station from which it was putted into the device.

A further object of the present invention is to afford a novel golf putting practice device of the aforementioned type, which will return the ball to a golfer making a putt by knocking or "kicking" the ball from the device.

Golf putting practice devices which will kick the ball back to a person using the same, have been heretofore known in the art, such as, for example, as shown in my U.S. Pat. Nos. 2,709,594, 3,003,769, 3,030,113, 3,134,597, 3,134,934, 3,697,079 and 3,854,728 and in U.S. Pat. No. 2,908,503, issued to C. J. Austin, et al, and the like. It is an important object of the present invention to afford novel improvements over the golf putting practice devices heretofore known in the art.

Another object of the present invention is to afford a novel, effective simulation, in a golf putting practice device, of the cup used in actually playing a game of golf.

Another object of the present invention is to afford a novel golf putting practice device which will indicate in a novel and expeditious manner to a person making a putt thereinto the quality of the putt, with the range of indication being from "perfect" to "poor."

Yet another object of the present invention is to afford a novel golf putting practice device which will indicate in a novel and expeditious manner to a person making the putt, whether it was a "perfect" putt or merely a "good" putt.

A further object of the present invention is to afford a novel golf putting practice device of the aforementioned type, operable to kick a ball received therein back to the person making a putt, wherein the return of the ball is insured in a novel and expeditious manner.

Another object of the present invention is to afford a novel golf putting practice device of the aforementioned type, operable to return a ball to the person making the putt, which is constituted and arranged in a novel and expeditious manner effective to insure quick return of the ball to the person making the putt.

Another object of the present invention is to afford a novel golf putting practice device which is practical and efficient in operation, and which may be readily and economically produced commercially.

Other and further objects of the present invention will be apparent from the following description and claims and are illustrated in the accompanying drawings which, by way of illustration, show the presently preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

A golf putting game device 1, embodying the principles of the present invention, is shown in FIGS. 1–5, inclusive, of the drawings to illustrate the presently preferred embodiment of the present invention.

The golf putting practice device 1, embodies, in general, a base 2 having an upwardly open pocket 3 therein for receiving a putted golf ball, with a kicker device 4 being disposed adjacent to the pocket 3 for returning a putted ball from the device 1 to the putting position from which a person putted the ball thereinto.

Figure 1:
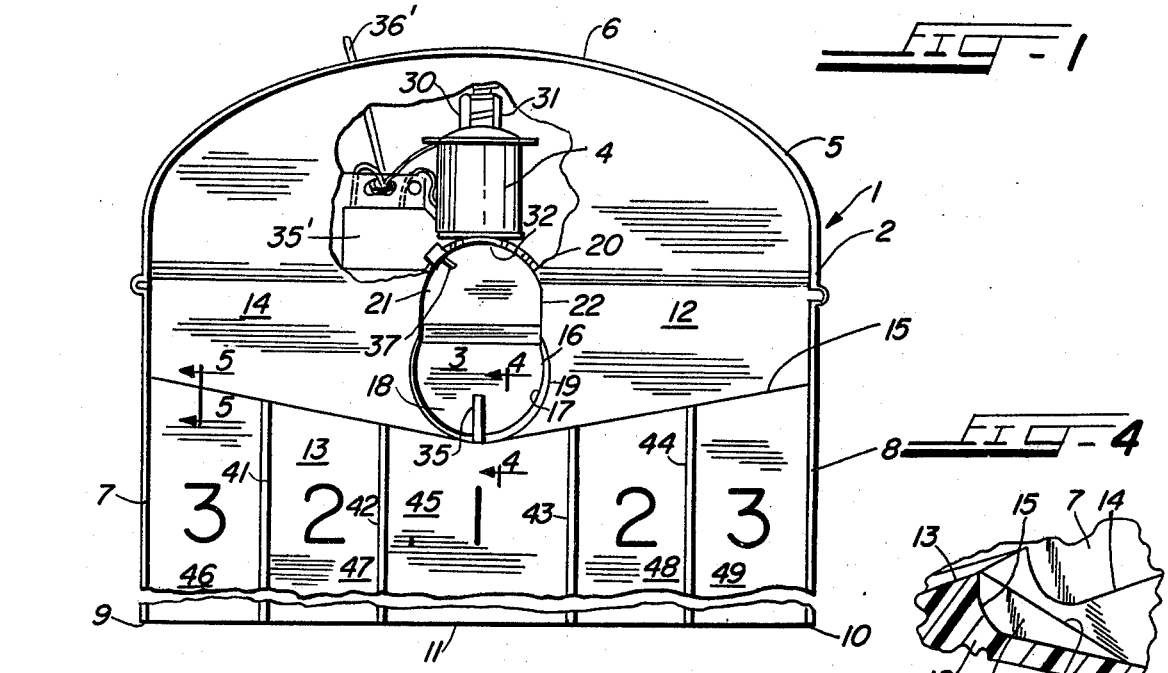
FIG. 1 is a fragmentary, top plan view of a golf putting practice device embodying the principles of the present invention.

The base 2 includes an elongated, laterally upstanding wall 5, having an intermediate or rear portion 6 extending between two side portions 7 and 8, FIG. 1. The wall 5 extends along the periphery of the base 2, and the side portions 7 and 8 terminate at their front ends 9 and 10, respectively, at the front end of the device 1, in uniplanar relation to the front edge 11 of the floor 12.

The floor 12 includes a front ramp 13, which slopes upwardly and rearwardly from the front edge 11, and a rear ramp or main body portion 14, which extends rearwardly from the rear edge portion of the front ramp 13. The rear edge of the front ramp 13 is disposed at a higher elevational level than the front edge of the rear ramp 14 of floor 12 to afford a rearwardly facing ridge 15 at the junction of the front ramp 13 and the rear ramp 14 of the floor 12. The front ramp 13 extends between and is supported by the front end portions of the side portions 7 and 8 of the wall 5, and the rear ramp or main body portion 14 of the floor 12 is supported by the portions 6-8 of the wall 5 at a higher elevational level than the front edge 11. Preferably, the sidewall 5 and floor 12 are of one-piece construction, being molded of any suitable material, such as for example, high impact polystyrene, or the like.

An opening or hole 16 is formed in the floor 12 to define the upper end of the pocket 3, for a purpose which will be discussed in greater detail presently. In the preferred form of golf putting game device 1, shown in the drawings, the opening 16 is formed in the front edge portion of the main body portion 14 of the floor 12 immediately adjacent the ridge 15, in centered position between the side portions 7 and 8 of the wall 5, the opening 16 terminating at its rear edge in forwardly spaced relation to the rear portion 6 of the wall 5.

The pocket 3 includes an upstanding sidewall 17 defining the outer periphery thereof, and a bottom wall 18 extending across and closing the bottom of the sidewall 17. The pocket 3 embodies a main body portion 19 at the front thereof, which comprises the major portion of a circle. The front edge of the main body portion 19 of the cup 3 is disposed in substantially tangential relation to the ridge 15, and the pocket 3 embodies a relatively small, concave-rearwardly indention or depression 20 disposed substantially diametrically opposite the front edge of the main body portion 19, FIG. 1.

Two substantially straight, parallel sidewalls 21 and 22 extend between and interconnect the main body portion 19 of the cup 3 and the depression 20. The two sidewall portions 21 and 22, together with the depression 20, afford a recess for receiving a golf ball to be ejected from the device 1, as will be discussed in greater detail presently. The diameter of the main body portion 19 of the pocket 3, parallel to the front edge 11, preferably is relatively small as compared to that of a golf ball. For example, the diameter of a United States golf ball is 1.68 inches and in the preferred form of the present device, the diameter of the main body portion 19 of the pocket 3 is $2\frac{1}{4}$ inches.

Figure 2:
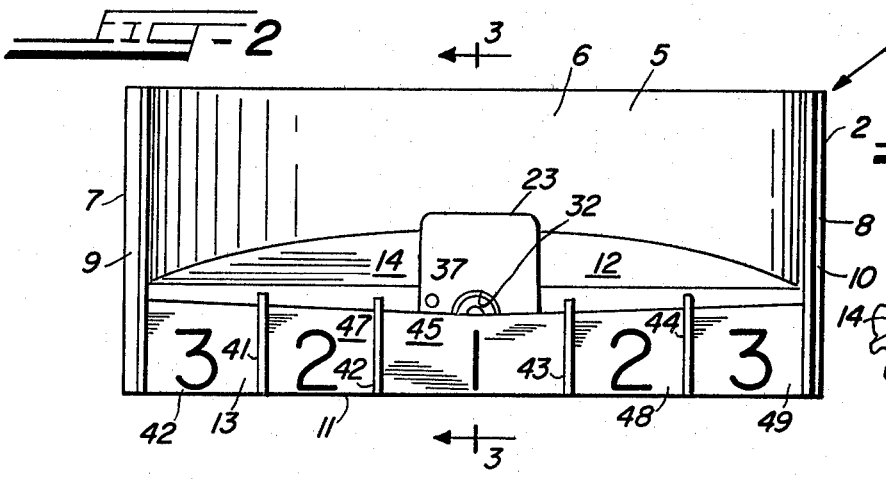
FIG. 2 is a front elevational view of the golf putting practice device shown in FIG. 1.
Figure 3:
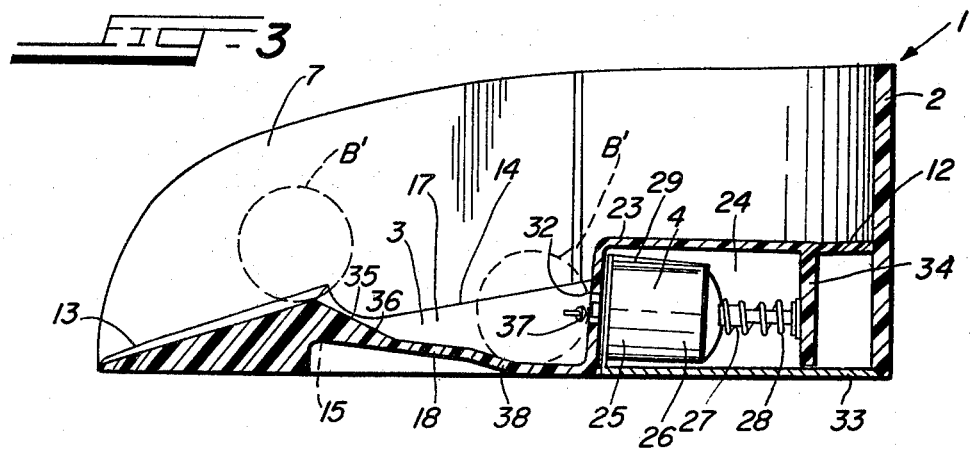
FIG. 3 is a longitudinal sectional view taken substantially along the line 3—3 in FIG. 1.
Figure 4:
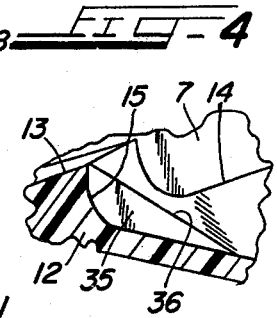
FIG 4. is a detail, fragmentary sectional view taken substantially along the line 4—4 in FIG. 1.
Figure 5:
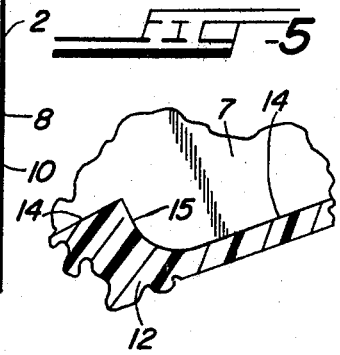
FIG. 5 is a detail, fragmentary sectional view taken substantially along the line 5—5 in FIG. 1.

An elongated ridge 23, which is formed integrally with the main body portion 14 of the floor 12, extends across the upper face of floor 12 midway between the wall portions 7 and 8, the ridge 23 extending rearwardly from the rear edge portion of the depression 20 and terminating forwardly of the rear portion 6 of the wall 5, FIGS. 1, 2 and 4. The ridge 23 preferably is gently curved upwardly from the main body portion 14 of the floor 12 in all directions, and affords the top wall of a recess 24 in the base 2, in which the kicker 4 is disposed, FIG. 3.

All portions of the main body portion 14, exteriorly of the ridge 23, slopes directly downwardly and forwardly toward the ridge 15 at a ball-impelling angle, such as, for example, 12°. Thus, it will be seen that any golf ball coming to rest on the main body portion 14 will roll by gravity toward the ridge 15.

Both end portions of the ridge 15 slope rearwardly away from the center thereof at a suitable ball impelling angle, such as, for example, the aforementioned twelve degrees. Thus, because of the slope of the main body portion 14 and the ridge 15, any ball coming to rest against the ridge 15 will roll by gravity along the ridge 15 into the main body portion 19 of the pocket 3.

The rear portion 6 of the wall 5, and those portions of the side portions 7 and 8 of the wall 5 disposed rearwardly of the ridge 15 preferably project substantially vertically above the top surface of the main body portion 14 of the floor 12 a distance greater than the diameter of a golf ball. Also, the rear wall of the ridge 15 preferably extends substantially vertically above the adjacent top surface of the main body 14 of the floor 12 throughout its length a distance of between one-half and two-thirds the radius of a golf ball. For example, the ridge 15 may extend above the main body portion 14 a distance of seven-sixteenths inch at the center thereof and one-half inch at the ends thereof. With this construction, it is substantially insured that any golf ball putted across any portion of the front ramp 13 will be retained on the device 1 in such a manner that it will pass into the pocket 3, even though it is putted at such a speed that it passes around the main body portion 14 of the floor 12 in engagement with the wall 5 and strikes the ridge 15 with considerable force, the ball, under such conditions, tending to bounce straight up in the air and come back down on the main body portion 14 of the floor 12.

It will be remembered that the golf putting practice device 1 embodies a kicker device 4 for returning a putted ball to the person making the putt. The kicker device 4 comprises a solenoid 25 embodying a coil 26 and a plunger 27, the plunger 27 normally being held in retracted position by a compression coil spring 28, FIG. 3. The base 2 has a socket 29, FIG. 3, afforded by two parallel ribs 30 and 31, FIG. 1, which project downwardly from the floor 12. The socket 29 is so disposed in the base 2 that when the kicker device 4 is disposed in operative position therein, it is disposed immediately behind the depression 20 with the plunger 27 disposed in axial alignment with, and immediately behind, an opening 32, FIGS. 2 and 3, formed in the portion of the sidewall 17 of the pocket 3 in which the depression 20 is formed. A bottom plate 33 is removably mounted by suitable means, such as screws, not shown, on the rear portion of the base 2 in the assembled golf putting game device 1 in underlying relation to the kicker device 4, FIG. 3. The socket 29 is so disposed in the base 2, that, in the assembled device 1, the bottom plate 33 snugly retains the kicker device 4 therein. It its normal, at-rest position the plunger 27 is fully retracted and yieldingly held in abutting engagement with a downwardly projecting partition wall 34 in the base 2, defining the rear end of the socket 29, FIG. 3.

The sidewall portions 21 and 22, disposed on opposite sides of the depression 20 in the pocket 3, preferably are spaced from each other a distance only slighly greater than the diameter of a golf ball, such as, for example, thirty-thousandths of an inch. The depression 20 is preferably of such size and configuration that it is complementary to the outside size and shape of that portion of the golf ball which is disposed therein, when the ball is disposed between the sidewall portions 21 and 22 in its most rearward position in the pocket 3. Preferably, the sidewall portions 21 and 22 project forwardly from the rear of the depression 20 such a distance that when a golf ball is so disposed in the depression 20, they project beyond the center of the golf ball. With the recess thus afforded by the depression 20 and the sidewall portions 22 of such size, it affords an effective holding device for normally holding a ball to be ejected in proper position in the pocket 3.

A control switch 35', FIG. 1, is connected between the solenoid coil 26 and a power cord 36', and a plunger type switch button 37 is disposed in the depression 20 of the pocket 3 in position to be engaged by a ball, such as the ball B, FIG. 3, disposed in operative position in the depression 20, to thereby close the switch 35' and actuate the solenoid 25.

The entire upper face of the bottom 18 of the pocket 3 slopes downwardly and rearwardly at not less than a ball impelling angle, such as, for example, five degrees, so that balls disposed in the pocket 3 will be caused to roll toward the rear thereof. The portion 38 of the bottom 18 of the pocket 3, FIG. 3, on which a golf ball, such as the ball B rests, when it is disposed in its aforementioned rearwardmost position in the depression 20, is at a somewhat greater angle, such as, for example, 15°. With the pocket 3 constructed in this manner, balls putted thereinto are effectively engaged by the sidewalls thereof as to normally insure that the ball will come to rest in the depression 20 without bouncing away from the kicker element 4.

The portion 38 of the bottom 18 of the pocket 3 is disposed between the sidewall portions 21 and 22 and is so disposed, and is of such size as to normally insure that a ball to be ejected from the golf putting practice device 1 is resting thereon and is supported entirely thereby at the time it is to be ejected. The angle of inclination of the portion 38 of the bottom 18 is such that when a ball is disposed in operative position in the depression 20 and is struck by the plunger 27 of the kicker element 4 in an ejecting operation, the engagement of the portion 38 with the ball is such that the ball is caused to bounce or to be thrown forwardly over the ridge 15, as illustrated by the ball B', FIG. 3, and be returned to the person who made the putt.

The angle of inclination of the portion 38, of course, will vary with the height of the ridge, such as the ridge 15, over which it is to be ejected, and with the force with which the ball is struck by the kicker element, such as the kicker element 4. For example, it has been found that, with the ridge 15 having a height of $1\frac{5}{8}$ inches above the area 38, and with the kicker element 4 striking the ball at an upwardly inclined angle of 5° with a force sufficient to roll a golf ball 20–25 feet across the usual carpet, the slope of the area 38 may be 13° to 20°, and preferably is in the nature of 15°.

However, in certain instances, when a "perfect" putt is made so that the ball rolls across the ramp 13 directly into the pocket 3, and, particularly, when such a putt is made with substantial force, it can strike the portion of the sidewall 17 of the pocket 3, forming the rear portion of the depression 20 with sufficient force that it bounces upwardly. Under such conditions, if the pushbutton switch 37 is actuated by the ball, the kicker device 4 is actuated so that the plunger 27 strikes the ball B while it is still in the air and thus, instead of bouncing it over the ridge 15, will cause it to fly forwardly, substantially horizontally, directly toward the ridge 15. However, in my novel golf putting practice device 1, an elongated rib 35 is disposed in the pocket 3 in upright position on the bottom wall 18, FIGS. 1 and 3, the rib 35 extending rearwardly from the ridge 15 in substantially axial alignment with the opening 32 through which the plunger 27 moves. The upper surface 36 of the rib 35 slopes upwardly and forwardly from the bottom wall 18 of the pocket 3 to the top of the ridge 15 at a suitable angle, such as, for example, 45° to the horizontal, so that any balls such as the ball B, driven against the upper surface 36 by the plunger 27 is deflected upwardly by the surface 36 for passage forwardly over the ridge 15 back toward the person making the putt. With this construction, the danger of a ball, such as the ball B, being driven by the kicker device 4 directly into the ridge 15 is eliminated. Without the rib 35 being disposed in the aforementioned operative position thereof, such a ball, striking the ridge 15 creates a loud noise, and, oftentimes, the ball is caused to fly substantially vertically up into the air and then back down into the pocket 3. In addition, the rib 35 is so disposed in the pocket 3 that, as the balls move downwardly along the ridge 15 into the front end portion of the pocket 3, it is insured that the balls will not pass laterally across the front end portion of the pocket 3, even when the balls are rolling at a substantial rate of speed, the rib 35 affording an effective barrier for stopping the balls in the front end portion of the pocket 3 and thus insuring that the balls quickly roll rearwardly into the rear portion of the pocket 3 for ejection from the golf putting practice device 1.

For the purpose of quickly guiding a ball, striking the side of the rib 35, into the rear of the pocket 3 for ejection from the golf putting practice device 1, the width of the rib may vary, depending on the diameter of the front portion 19 of the pocket 3. Thus, for example, with the diameter of the front portion 19 being the aforementioned $2\frac{1}{4}$ inches, the thickness of the rib 35 preferably is in the nature of 1/16 inch--this compared to an overall width of the device 1, between the sidewalls 7 and 8 in the nature of 12 inches. If the diameter of the front portion 19 of the pocket 3 is larger the thickness of the rib 35 preferably is proportionately greater.

Four relatively narrow, upstanding, elongated ribs or flanges 41, 42, 43 and 44 extend across the upper face of the front ramp 13 from the front edge 11 to the ridge 15 in substantially parallel, spaced relation to each other. The central ribs 42 and 43 are spaced from each other the same distance as the diameter of a standard putting cup on a golf course, namely, in the nature of $4\frac{1}{4}$ inches, and are disposed equal distances from the longitudinal center line of the putting cup 1, on respective opposite sides thereof. The ribs 41 and 44 are disposed midway between the wall portion 7 and the flange 42 and midway between the wall portion 8 and the flange 44, respectively, the spacing of the flanges 41 and 44 from the respective adjacent flanges 42 and 43 and the respective adjacent portions of the wall 5 being greater than the width of a golf ball so that a ball may be rolled upwardly through such spaces onto the main body portion 14 of the floor 12 for a purpose which will be discussed in greater detail presently.

As will be discussed in greater detail presently, the golf putting practice device 1 is constructed in such a manner that an effective indication is afforded a person using the device as to the quality of a putt made thereinto. Thus, if a golf ball is putted from in front of the device 1 onto the ramp 13, and if it is putted into the portion 45 of the ramp 13, disposed between the ribs 42 and 43 at sufficient speed to move upwardly over the ridge 15, it will drop down into the pocket 3, or onto the immediately adjacent portion of the rear portion 14 of the floor 12, for passage into the pocket 3 and return therefrom to the person making the putt. The fact that the ball passed into the portion 45 of the ramp 13 indicated that the putt was of such a nature that it would have been "holed" if it had been made during a regular game, and, therefore, was, at least, a "good" putt. On the other hand, if the ball that is putted passes upwardly over any one of the portions 46—49 of the ramp 13 disposed outwardly of the portion 45, it also will roll downwardly along the rear portion 14 of the floor 12 into the pocket 3 for return to the person making the putt. However, the fact that the ball passed outwardly of the portion 45 of the front ramp 13 showed that it would have been wide of the cup and have been a "missed" putt if made in a regular golf game.

In addition, it will be remembered that the front portion 19 of the pocket is smaller in diameter than the distance that the ribs 42 and 43 are spaced apart. Inasmuch as the pocket 3 is centered between the wall portions 7 and 8, and thus between the flanges 42 and 43, it will be seen that, when the ball not only is putted across the portion 45 of the ramp 13 to indicate a "good" putt that would have been "holed" in a golf game, when the ball so passes across the portion 45 directly into the pocket 3, this indicates that it was a "perfect" putt directly into the center of the "cup" of the imaginary golf game.

From the foregoing it will be seen that the present invention affords a novel golf putting practice device which may be effectively used by both the good golfer and the poor golfer.

Also, the present invention affords a novel golf putting practice device which is effective to return both good and bad putts to a golfer making the same.

In addition, the present invention affords a novel golf putting practice device which is effective to so return putted golf balls to the golfer making the putts, even though the balls may be bouncing when struck by the ejector.

In addition, it will be seen that the present invention affords a novel golf putting practice device, which is operable to effectively indicate to a golfer making a putt thereinto the degree of quality of his putt through all ranges thereof from a "bad" putt which would have been wide of an actual golf hole to a "perfect" putt which was directly on line with the center of the hole, through the range of a "good" putt, which would have gone into the hole if it had been made in an actual golf game, but which was slightly off line from the center of the hole and, therefore, did not constitute a "perfect" putt.

Also, it will be seen that the present invention affords a novel golf putting practice device which is practical and efficient in operation and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. A golf putting practice device comprising:
   a. a base including
      (1) a ramp sloping upwardly and rearwardly from a front edge thereof to a rear edge thereof,
      (2) a pocket
         (a) disposed rearwardly of said ramp, and
         (b) having
            (1') a substantially upright front wall, and
            (2') a substantially upright rear wall,
   b. kicker means for ejecting a ball forwardly from said pocket,
   c. a rib
      (1) projecting rearwardly from said front wall in laterally centrally disposed position in said pocket, and
      (2) having a top surface sloping downwardly and rearwardly from said front wall in position for balls projected forwardly from said rear wall at a level below the top of said front wall to be deflected upwardly and forwardly out of said pocket.

2. A golf putting practice device as defined in claim 1, and in which
   a. said top surface slopes downwardly and rearwardly from the top of said rear edge of said ramp to the bottom of said pocket at an upwardly and forwardly opening acute angle to the horizontal.

3. A golf putting practice device as defined in claim 2, and in which
   a. the lateral thickness of said rib in a direction parallel to said rear edge is a small fraction of the lateral width of said pocket in a direction parallel to said rear edge.

4. A golf putting practice device comprising
   a. a base including
      (1) a floor, and
      (2) an elongated wall
         (a) projecting laterally upwardly from a peripheral edge of said floor, and
         (b) terminating at its opposite ends on respective sides of a front edge portion of said floor,
   b. said front edge portion including a ramp sloping upwardly and rearwardly from the front edge of said floor,
   c. the remainder of said floor, rearwardly of said front edge portion,
      (1) having a ball receiving pocket therein, and
      (2) sloping, at a ball impelling angle,
         (a) downwardly and forwardly toward said front edge portion, and
         (b) inwardly toward said pocket,
   d. said pocket including
      (1) an upright front wall disposed at the rear edge of said ramp,
      (2) an upright rear wall disposed rearwardly of said front wall, and
      (3) a bottom wall sloping downwardly and rearwardly from said front wall toward said rear wall,
   e. kicker means for ejecting a ball from said rear wall outwardly of said pocket forwardly over said front wall, and
   f. a rib projecting
      (1) rearwardly from said front wall, and
      (2) upwardly from said bottom wall in substantially centrally disposed position laterally of said pocket,
   g. said rib
      (1) being disposed in position to abuttingly engage a ball rolling along the front edge portion of said remainder of said floor in engagement with said front wall to thereby stop passage of said ball laterally across said pocket in that direction, and
      (2) having a top surface sloping downwardly and rearwardly from the top of said rear edge to said bottom wall in position to engage and deflect a ball upwardly and forwardly out of said pocket when said ball is ejected forwardly from said rear wall at a level below the top of said front wall.

5. A golf putting practice device as defined in claim 4, and in which
   a. said pocket is disposed in spaced relation to said elongated wall.

6. A golf putting practice device as defined in claim 5, and in which
   a. the lateral thickness of said rib in a direction parallel to said rear edge is a small fraction of the lateral width of said pocket in said last mentioned direction.

7. A golf putting practice device as defined in claim 6, and
   a. which includes
      (1) a plurality of spaced, upwardly projecting, elongated ribs extending across said ramp from said front edge to said rear edge thereof, and
   b. in which
      (1) said ribs are spaced from each other and from said ends of said elongated wall for the passage of a golf ball therebetween across said ramp from said front edge thereof across said rear edge thereof onto said remainder of said floor.

8. A golf putting practice device as defined in claim 7, and in which a. two of said last mentioned ribs are (1) substantially centrally disposed between said ends of said elongated wall, and (2) spaced from each other not substantially more or less than $4\frac{1}{4}$ inches.

9. A golf putting practice device as defined in claim 8, and in which a. said pocket includes (1) a front portion, and (2) a rear recess in the side thereof remote from said ramp, b. said front portion of said pocket is (1) substantially axially aligned with the center line between said two ribs, and (2) of lesser width, parallel to said front edge of said floor than $4\frac{1}{4}$ inches.

10. A golf ball putting practice device as defined in claim 9, and in which a. said ribs extending across said ramp, other than said two ribs are spaced from laterally adjacent ribs and said ends of said elongated walls a lesser distance than the spacing between said two ribs.

* * * * *